US006939653B2

(12) United States Patent
Suzuki et al.

(10) Patent No.: US 6,939,653 B2
(45) Date of Patent: Sep. 6, 2005

(54) IMAGE-FORMING COLOR TONER, DEVELOPING AGENT, IMAGE-FORMING APPARATUS, TONER CONTAINER, IMAGE-FORMING PROCESS CARTRIDGE AND IMAGE-FORMING PROCESS

(75) Inventors: Masanori Suzuki, Shizuoka (JP); Yohichiroh Watanabe, Shizuoka (JP); Keiko Shiraishi, Shizuoka (JP); Toyoshi Sawada, Kanagawa (JP); Takuya Saito, Shizuoka (JP); Masashi Nagayama, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/329,362

(22) Filed: Dec. 27, 2002

(65) Prior Publication Data

US 2003/0165759 A1 Sep. 4, 2003

(30) Foreign Application Priority Data

Dec. 28, 2001 (JP) ..... 2001-401512

(51) Int. Cl.[7] ..... G03G 9/08

(52) U.S. Cl. ..... 430/108.4; 430/109.4; 430/110.1

(58) Field of Search ..... 430/108.4, 109.4, 430/110.1

(56) References Cited

U.S. PATENT DOCUMENTS

| | | | | |
|---|---|---|---|---|
| 5,298,354 A | * | 3/1994 | Matsunaga et al. | 430/108.4 |
| 5,665,508 A | | 9/1997 | Inagaki et al. | |
| 5,750,299 A | | 5/1998 | Ohshima et al. | |
| 5,912,100 A | | 6/1999 | Aoki et al. | |
| 6,004,715 A | | 12/1999 | Suzuki et al. | |
| 6,010,814 A | | 1/2000 | Kotsugai et al. | |
| 6,074,795 A | | 6/2000 | Watanabe et al. | |
| 6,103,441 A | | 8/2000 | Tomita et al. | |
| 6,168,894 B1 | | 1/2001 | Aoki et al. | |
| 6,180,298 B1 | | 1/2001 | Kuroda et al. | |
| 6,228,550 B1 | | 5/2001 | Matsuda et al. | |
| 6,335,137 B1 | | 1/2002 | Suzuki et al. | |
| 6,363,229 B1 | | 3/2002 | Shiraishi et al. | |
| 6,468,706 B2 | | 10/2002 | Matsuda et al. | |
| 6,492,083 B1 | * | 12/2002 | Livengood et al. | 430/108.4 |
| 2002/0037467 A1 | | 3/2002 | Watanabe et al. | |

FOREIGN PATENT DOCUMENTS

| | | |
|---|---|---|
| EP | 0 066 395 | 12/1982 |
| EP | 0 421 416 | 4/1991 |
| EP | 0 926 563 | 6/1999 |
| JP | 52-3304 | 1/1977 |
| JP | 60-93457 | 5/1985 |
| JP | 2-160250 | 6/1990 |
| JP | 4-194967 | 7/1992 |
| JP | 4-337737 | 11/1992 |
| JP | 5-61242 | 3/1993 |
| JP | 7-82255 | 9/1995 |
| JP | 8-220808 | 8/1996 |
| JP | 9-106105 | 4/1997 |
| JP | 9-304964 | 11/1997 |
| JP | 10-293425 | 11/1998 |
| JP | 11-125948 | 5/1999 |
| WO | WO 02/093267 | 11/2002 |

* cited by examiner

*Primary Examiner*—Christopher RoDee
(74) *Attorney, Agent, or Firm*—Oblon, Spivak, McClelland, Maier & Neustadt, P.C.

(57) ABSTRACT

An image-forming color toner contains at least a colorant, a resin (A), a modified resin (B) and a wax (a) as a mold releasing agent, the image-forming color toner having a phase separated structure comprising the modified resin (B) as a domain in the resin (A) as a continuous phase, and wax (a) being effectively contained the modified resin (B). The modified resin (B) has a wax part containing a wax component (b), and a modified part formed of a vinyl monomer unit and an average ester group concentration of 8% by weight to 30% by weight.

17 Claims, 2 Drawing Sheets

IMAGE-FORMING COLOR TONER, DEVELOPING AGENT, IMAGE-FORMING APPARATUS, TONER CONTAINER, IMAGE-FORMING PROCESS CARTRIDGE AND IMAGE-FORMING PROCESS

BACKGROUND OF THE INVENTION

1. Field of the Invention

The present invention relates to an image-forming color toner for electrophotography and electrostatic printing, a developing agent containing the same, an image-forming apparatus using the same, a toner container containing the same, an image-forming process cartridge containing the same, and image-forming process using the same.

2. Description of the Related Art

In the conventional image-forming dry process of electrophotography, electrostatic printing, electrostatic recording, and the like, a dry toner generally includes at least a binder resin and a colorant as a principal composition, and frictional electrification is applied to the dry toner by a charger. Thereafter, a latent image is developed by the charged toner so as to form a toner image, and the toner image is transferred and fixed onto a recording paper. In order to obtain a high-quality image, the most important question is how to develop a latent image formed on a photoconductor (also referred as "a latent image bearing member" hereinafter) accurately using a toner under various conditions in this process, and studies are currently being performed thereon.

The properties required of a developing agent, which can achieve a high-quality image, are storage properties (anti-blocking properties), transport properties, developing properties, transfer properties, charging properties, image fixing properties, and the like.

In general a process used to fix a dry toner on a recording material is of the contact and heating image-fixing type wherein a roller or a belt with a flat and smooth surface is heated, and pressed in contact with the toner. As a heating efficiency is high, in this method, high-speed fixing is possible, and gloss and transparency may also be imparted to a color toner. On the other hand, a so-called "offset phenomenon" may occur as the result of that the heated fixing member surface is released after the contact with the toner in the molten state under pressure. Namely, a part of the toner image adheres to the surface of the fixing roller and then transferred to another image. To prevent this offset phenomenon, it is common to employ a method that a surface of the fixing roller is formed of silicone rubber or fluorinated resin which have excellent mold releasing effects, and a mold releasing oil such as a silicone oil is coated thereon. Although this method is very effective to prevent offset there still remains a problem in that an apparatus for supplying a mold releasing oil is required so that a fixing apparatus becomes bulky and costly. Hence, with monochrome toners, there is a recent trend to increase an elasticity of a molten toner by adjusting a molecular weight distribution of a binder resin so that the molten toner does not internally fracture and to add a mold releasing agent such as wax to the toner. This method allows the image forming method not to apply the mold releasing oil to the fixing roller, or to applying only a small amount of the mold releasing oil.

In color image-formation by a full color electrophotography, however, it is generally required to use a three-color toner having the three colors of yellow, magenta and cyan, or a four-color toner with the addition of black, to laminate and reproduce all the colors, and give a clear color image with excellent color reproducibility. To obtain a clear color image, a surface of the fixed toner image must be smoothed some extent to reduce light scattering. This means that the viscoelasticity in the molten state must be reduced. Thus, when forming a full color image, offset tends to occur more easily than with a monochrome toner having no gloss, and it is less suitable to use an oilless image fixing apparatus or to use only a small amount of the oil coating. Moreover, if a mold releasing agent is contained in the toner, a transferability to transfer paper decreases as a result of an increase in a toner adherence, and charging properties are also degraded as a result of a contamination occurred to a frictional charger such as a carrier by the mold releasing agent in the toner. This led to a decline in the durability of the developing agent.

In image fixing methods, a heat roller fixing method is often used because it has a simple apparatus construction and easy handling. However, the heat roller fixing which is frequently used in the related art has the following problems:

(1) a waiting time until a heating roller reaches a predetermined temperature is long;

(2) the heating roller must be maintained at a suitable temperature to prevent fixing defects or offset due to temperature fluctuations of the heating roller resulting from a passage of recording materials or other external factors, so that an increase of the thermal capacity is required in the heating roller or the heating body; also in general, in the case of full color toners with low viscosity, (3) due to the curvature of the roller, there is a problem of offset or the toner being taken up by the roller during paper discharge, and it is necessary to provide a mold releasing oil and install an oil tank for the mold releasing oil.

To resolve these problems, a belt heating fixing method has been proposed, as well as a belt fixing method where oil is not applied (oilless method) or only a small amount is applied. However, a pressure is small and the pressure cannot be used effectively as a means of obtaining high gloss in the belt fixing method, whereas a roller having an elastic body of a certain thickness is often used and a high pressure is often applied in the full color roller fixing method as described above.

There are following methods for obtaining high gloss in belt fixing.

Japanese Patent Application Laid-Open (JP-A) No. 02-160250 discloses a method in which an average particle diameter, a fine powder content and a rough powder content are specified, and toner surface imperfections are eliminated. However, in this case, a glossy image is not necessarily obtained even if there are few imperfections on the recording material and the toner is adhering to it.

For increasing flatness and obtaining high gloss, in JP-A No. 11-125948, a method is described for specifying a surface roughness of the image on an OHP sheet. However in this case, as the surface properties of an OHP sheet are different from those of paper, even if the surface roughness of the image on the OHP sheet is specified, offset and glossiness are not necessarily good depending on the surface properties of the paper.

Although glossy images were often desired with full color images, there is now a large demand on printer output, and it may occur that too much gloss is not desirable. Further, a non-glossy image may also be desired in some cases. Hence, it is required to be able to obtain images of differing glossiness depending on the case. To address this need, JP-A No. 04-194967 proposes a fixing method wherein a selection can be made between high gloss and no gloss with one fixing apparatus. However, conditions for obtaining high gloss are disadvantageous for offset, so depending on the conditions, they may not be sufficient tolerance to offset. Specifically, offset does not occur in the beta area, but there is a problem of offset (fine offset) in the halftone parts.

Also, depending on the fastness of the gloss under conditional changes, the properties of gloss may be affected to considerable extent. Thus the glossiness becomes unstable in changeable conditions.

Various types of toner have been discussed in the related art. For example, JP-A No. 08-220808 proposes a toner using a linear polyester resin having a softening point of 90° C. to 120° C. and carnauba wax, JP-A No. 09-106105 proposes a toner containing a resin and wax which are compatible and have different softening points, JP-A No. 09-304964 proposes a toner specifying a melt viscosity of a polyester resin and wax, JP-A No. 10-293425 proposes a toner containing a polyester resin having a softening point of 90° C. to 120° C., rice wax, carnauba wax and a silicone oil, and JP-A No. 05-61242 proposes wax occlusion polymer toner. Although all of these toners gave a suitable gloss, anti-offset properties were insufficient even if mold releasing oil was not coated or was coated in only a small amount on the fixing roller, and the toners did not have very good transfer properties, durability, charge stability relative to humidity or crushing properties.

In recent years, market demands for high-quality images are increasing, and as sufficiently high image qualities can no longer be obtained with a toner having a weight average particle diameter of 9 μm to 15 μm of the related art, a toner of still finer particle diameter is required. As the specific surface area increases the smaller particle diameter of the toner is, the powder fluidity of the parent colorant particles decreases, a large amount of external additives must be added as a surface treatment to confer fluidity. If it is attempted to obtain a desired fluidity, moreover, the aforesaid side-effects become more obvious. Also, the mold releasing agent separates due to stress and the like. In particular, toners manufactured by pulverization have a narrow molecular weight distribution and the brittle mold releasing agent easily becomes a pulverization interface, so the surface of the mold releasing agent became exposed which was frequently found in fine powder. Therefore, making the toner particles finer to obtain high image quality imposes a stricter requirement on filming. To resolve these problems, in toners using a styrene resin as the toner binder, it is known that polyolefin mold releasing agents such as low molecular weight polyethylene or low molecular weight polypropylene, or resins wherein a styrene resin has been grafted onto these polyolefin resins, are effective (Japanese Patent Application Publication (JP-B) No. 52-3304, JP-B No. 07-82255, and the like). However, as the styrene resins used here have poor low temperature fixing properties, there was a problem in lowering the fixing temperature to satisfy energy-saving demands in recent years. To improve low temperature fixing properties, studies were performed using polyester resin as the binder resin which has excellent low temperature fixing properties. However, if polyester resins are used alone, the dispersion of the mold releasing agent in the polyester resin was insufficient, and if only one type of polyester resin was used, it was difficult to maintain a sufficiently wide fixing temperature range having both low temperature fixing properties and hot offset properties.

SUMMARY OF THE INVENTION

An object of the present invention is to provide a color toner which gives a suitable image gloss and has an excellent color reproducibility, which has sufficient anti-offset properties even when a mold releasing oil is not coated on a fixing roller or is coated in only a small amount, and which has excellent transfer properties, durability, charge stability relative to humidity and crushing properties, an image-forming apparatus using thereof, and a toner container filled thereby. Further, another object of the present invention is to provide a color toner, a developing agent, an image-forming apparatus, a toner container and an image-forming process cartridge which give a suitable image gloss and has excellent color reproducibility, which have sufficient anti-offset properties even when a mold releasing oil is not coated on a fixing roller or is coated in only very small amount, and which have excellent transfer properties, durability, charge stability relative to humidity and crushing properties, even when a belt heat fixing method is employed wherein the waiting time until the fixing member reaches a predetermined temperature is short. In addition, another object of the present invention is to provide an efficient image-forming method providing the aforementioned properties.

After exhaustive studies aimed at resolving the aforesaid problems, the Inventors conceived the present invention.

In a first aspect of the present invention, the present invention is an image-forming color toner containing at least a colorant, a resin (A), a modified resin (B), and wax (a) as a mold releasing agent formed. Moreover, the image-forming color toner has a phase separated structure. Namely, the structure of the image-forming color toner comprises the modified resin (B) as a domain in the resin (A) as a continuous phase, and wax (a) being effectively contained in the modified resin (B). In the toner of the present invention, the modified resin (B) comprises a wax part formed of the wax component (b), and a modified part having a vinyl monomer unit and an average ester group concentration of about 8% by weight to about 30% by weight.

A second aspect of the present invention is a developing agent containing the image-forming color toner of the present invention.

A third aspect of the present invention is a toner container containing the image-forming color toner of the present invention therein.

A fourth aspect of the present invention is an image-forming apparatus containing a latent image bearing member, a charger, a light irradiator, a developer in which the toner container of the present invention is installed, a transfer, and a fixer. In the image-forming apparatus of the present invention, the charger charges the latent image bearing member, then the light irradiator exposes the latent image bearing member to light so as to form a latent image. Thereafter, the developer supplies the toner of the present invention to the latent image from the toner container of the present invention in order to develop the latent image to form a developed image. Finally, the developed image is transferred to a transfer medium by the transfer and then fixed by a terminated or endless belt of the fixer.

A fifth aspect of the present invention is an image-forming apparatus containing, a latent image bearing member, a charger, a light irradiator, a developer in which the toner of the present invention is contained, a transfer, and a fixer. In the image-forming apparatus of the present invention, the charger charges the latent image bearing member, then the light irradiator exposes the latent image bearing member to light so as to form a latent image. Thereafter, the developer supplies the toner of the present invention to the latent image in order to develop the latent image to form a developed image. Finally, the developed image is transferred to a transfer medium by the transfer and then fixed by a terminated or endless belt of the fixer.

A sixth aspect of the present invention is an image-forming process containing at least the following steps. The first step is to charge a latent image bearing member. The second step is to irradiate light imagewisely to the latent image bearing member charged by the charging step, so as to form a latent image. The third step is to develop the latent image by supplying the image-forming color toner of the present invention to the latent image so as to form a developed image. The forth step is to transfer the developed image formed by the developing agent of the present invention to a transfer medium, and to fix the developed image while the developed image is brought in contact with a ten ted or endless belt. Above mentioned steps may not be performed in his order.

A seventh aspect of the present invention is a process cartridge containing a developing apparatus holding a image-forming color toner of the present invention. The process cartridge of the present invention is formed in a one-piece construction and is attachable to and detachable from an image-forming apparatus.

DESCRIPTION OF THE PREFERRED EMBODIMENTS

Figure 1:
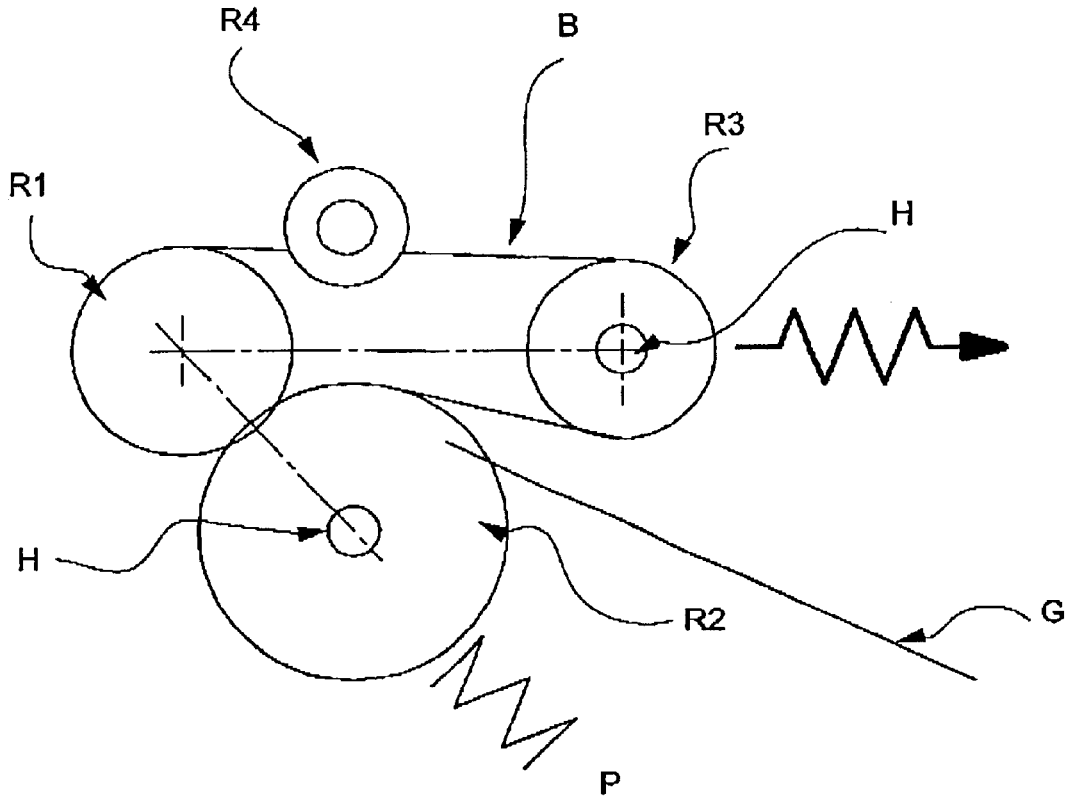
FIG. 1 is a diagram describing an example of a belt fixing apparatus.

The present invention relates to an image-forming color toner containing at least a colorant, a resin and wax as a mold releasing agent, and has the following characteristics:

(1) wax used as a mold releasing agent (in this specification, it will be referred as mold releasing wax or wax (a)) and a binder resin (referred as a resin (A)), are mutually incompatible, and have a structure wherein the wax is dispersed in the binder resin forming a continuous phase.

(2) a modified resin (referred to as a modified resin (B)) which is incompatible with the binder resin, and dispersed in the binder resin in a non-dissolved state.

(3) the modified resin contains at least a part of the mold releasing agent (wax (a)). In this case, the mold releasing agent (wax (a)) is included in a part of the modified resin. In particular, it is selectively included in the wax part of the modified resin (4) the modified resin contains a resin having a wax part formed of the wax component (b), and a modified part formed with a vinyl monomer unit having an average ester group concentration of about 8% by weight to about 30% by weight as a principal component. The main structure of the resin has a main chain containing the wax component (b) and a side chain (graft chain) containing a vinyl polymer chain. The side chain formed of a vinyl polymer chain, contains a vinyl monomer component having an ester group, and an average ester group concentration being in the range of about 8% by weight to about 30% by weight and preferably in the range of about 10% by weight to about 25% by weight.

As a specific description to (1), (2) and (3), the image-forming color toner has a phase separated structure. The phase separated structure has separate phases of a domain and a continuous phase. The domain is formed of the modified resin (B) and placed in the continuous phase formed of the resin (A). Moreover, the wax (a) is effectively contained in the domain formed of the modified resin (B).

In the modified resin used in the present invention, the wax (wax component (b)) which forms a part thereof generally has a softening point within the range of about 80° C. to about 170° C., and preferably within the range of 90° C. to 160° C. A number average molecular weight (Mn) thereof is in the range of about 500 to about 2000, and preferably in the range of 1000 to 15000, and a weight average molecular weight (Mw) thereof is in the range of about 800 to about 100000, and preferably in the range of 1500 to 60000. A ratio of the weight average molecular weight to the number average molecular weight (Mw/Mn) is in the range of about 1.1 to about 7.0, and preferably in the range of 1.3 to 4.0.

For the modified resin (modified resin (B)) used in the present invention, a number average molecular weight (Mn) thereof is in the range of about 1500 to about 100000, and preferably in the range of 2800 to 20000. A weight average molecular weight (Mw) thereof is in the range of about 6000 to about 100000, and preferably in the range of 7000 to 50000. A ratio of the weight average molecular weight to the number average molecular weight (Mw/Mn) is in the range of about 1.1 to about 40, and preferably in the range of 3 to 30. A glass transition temperature thereof is in the range of about 40° C. to about 90° C., and preferably in the range of 50° C. to 70° C. A softening point thereof is in the range of about 80° C. to about 150° C., and preferably in the range of 90° C. to 130° C.

In the toner of the present invention, at least a part of the mold releasing wax is contained in the modified resin. In this case, "contain" means that the mold releasing wax is selectively incorporated in the wax part of the modified resin because there is good compatibility between the wax part of the modified resin and the mold releasing wax.

A mold releasing wax content of the modified resin is about 33 parts by weight to about 1000 parts by weight, preferably 40 parts by weight to 250 parts by weight, and more preferably 50 parts by weight to 200 parts by weight, with respect to 100 parts by weight of the modified resin. Of all the wax contained in the toner, preferably 80% by weight or more, and more preferably 90% by weight or more is contained in the modified resin.

Unlike the conventional toner, the toner of the present invention doesn't occur the problems which are observed in the related art, even if the mold releasing wax is present in the vicinity of the toner particle surface. Thus the dispersion diameter of the wax can be made relatively large. As a result, the mold releasing agent of wax easily bleeds from the toner surface, and enhances the mold releasing effect.

The modified resin on the toner particle surface increases as the dispersion diameter in the binder resin increases, so wax tends to be present more easily in the vicinity of the particle surface. However, if the dispersion diameter of the modified resin in the resin increases too much, the dispersion diameter of the wax contained therein also tends to increase.

Regarding the dispersion diameter of the modified resin in the binder resin, a length of the long axis is preferably 0.1 $\mu$m to 2.5 $\mu$m, and more preferably 0.3 $\mu$m to 2.0 $\mu$m, and particularly preferably 0.3 $\mu$m to 1.5 $\mu$m. It is preferred that modified resin particles wherein the long axis longer than 2.5 $\mu$m, are not contained in the resin. Even if they are contained in the resin, a proportion of modified resin particles having a long axis longer than 2.5 $\mu$m is 1% by particle or less.

The binder resin used in the present invention is soluble in tetrahydrofuran (THF), and the modified resin is preferably also soluble in THF. It is preferred that these resins do not effectively contain an insoluble component.

It is preferred that a weight average molecular weight (Mw) of the binder resin by GPC is of about 10000 to about 90000. It is possible to obtain a color toner having a suitable gloss by using a binder resin which is of the preferred molecular weight and omits insoluble components. It is preferred, from the viewpoint of color reproducibility, that a glossiness of full color image is about 10% or more. A toner which attains his glossiness, can be obtained by using a binder resin which does not contain a THF-insoluble component. Namely, the binder resin is soluble in THF, and has a weight average molecular weight (Mw) of about 90000 or less, and preferably 50000 or less. If the weight average molecular weight (Mw) of the binder resin is more than about 100000, the anti-offset effect of the toner obtained may be inadequate.

There is no particular limitation on a particle diameter of the toner according to the present invention, but with regard to high image quality with excellent line reproducibility, a weight average particle diameter is within the range of about 2.5 $\mu$m to about 8.0 $\mu$m, and preferably within the range of 3.0 $\mu$m to 7.0 $\mu$m.

Nest, materials for the color toner of the present invention will be described in detail.

Although there is no particular limitation on the binder resin, preferred examples may include polyester resins, polyol resins, and the like, and these may be used alone or in combination.

The polyester resins may be obtained by condensation polymerization of diols and dicarboxylic acids. Examples includes diols such as polyethylene glycol, diethylene glycol triethylene glycol, 1,2-propylene glycol, 1,3-propylene glycol, 1,4-butane diol, neopentyl glycol and 1,4-butene diol; bisphenol ethers such as 1,4-bis (hydroxymethyl) cyclohexane, bisphenol A, hydrogenated bisphenol A, polyoxyethylene-modified bisphenol A and polyoxypropylene-modified bisphenol A; single diols having 3 to 22 carbon atoms substituted by saturated or unsaturated hydrocarbon groups, other single diols, and the like.

Examples of dicarboxylic acids used to obtain the polyester resin are maleic acid, fumaric acid, mesaconic acid, citraconic acid, itaconic acid, glutaconic acid, phthalic acid, isophthalic acid, terephthalic add, cyclohexane dicarboxylic add, succinic acid, adipic acid, sebacic acid and malonic add, divalent organic acid monomers having 3 to 22 carbon atoms substituted by saturated or unsaturated hydrocarbon groups, acid anhydrides thereof, dimers of lower alkyl esters and linoleic acid, and other bivalent organic acid monomers.

To obtain the polyester resin used as the binder resin, components due not only to the above bifunctional monomer may be used alone, but also trifunctional or higher polyfunctional monomers, may be suitably used in combination. Examples of polyol monomers having trivalent or more as polyfunctional monomers, are sorbitol, 1,2,3,6-hexane tetrol, 1,4-sorbitan, pentaerythritol, dipentaerythritol, tripentaerythritol, sucrose, 1,2,4-butane triol, 1,2,5-pentane triol, glycerol, 2-methylpropane triol, 2-methyl-1,2,4-butane triol, trimethylolethane, trimethylolpropane, 1,3,5-trihydroxymethylbenzene, and the like.

Examples of polycarboxylic acid monomers having trivalent or more as polyfunctional monomers, are 1,2,4-benzentricarboxylic add, 1,2,5-benzenetricarboxylic acid, 1,2,4-cyclohexane tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic add, 1,3-dicarboxyl-2-metyl-2-methylene carboxy propane, tetra (methylene carboxyl) methane, 1,2,7,8-octane tetracarboxylic acid, enbole trimer acid, add anhydrides thereof, and the like.

The polyol resin include a polyether polyol resin having an epoxy skeleton, and such a preferred polyol resin is as that the polyol resin obtained by a reaction of (1) epoxy resins, (2) alkylene oxide addition products of bivalent phenols or glycidyl ethers thereof, and (3) compounds having active hydrogen which react with epoxy groups.

The binder resin used in the present invention may be any of those known in the art, for example, a mixed resin of the aforesaid polyester resins or polyol resins. Examples of such mixed resins are styrene homopolymers such as polystyrene, poly p-chlorostyrene, polyvinyl toluene and substitution products thereof; and styrene copolymers such as styrene-p-chlorostyrene copolymer, styrene-propylene copolymer, styrene-vinyltoluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-$\alpha$-methyl chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleic ester copolymer, and the like. The following resins may also be blended: polymethyl methacrylate, polybutyl methacrylate, polyvinyl chloride, polyvinyl acetate, polyethylene, polypropylene, polyester, polyurethane, polyamide, epoxy resin, polyvinyl butyral, polyacrylic resin, rosin, modified rosin, terpene resin, phenol resin, aliphatic or alicyclic hydrocarbon resins, aromatic petroleum resin, chlorinated paraffin, paraffin wax.

In particular, the following binder resins are suitable for pressure fixing, and they may be used alone or in combination.

Examples of the binder resin may include polyolefins (low molecular weight polyethylene, low molecular weight polypropylene, polyethylene oxide polyethylene tetrafluoride), epoxy resins, polyester resins, styrene-butadiene copolymers (monomer ratio 5 to 30:95 to 70), olefin copolymers (ethylene-acrylic acid copolymer, ethylene-acrylic ester copolymer, ethylene-methacrylic acid copolymer, ethylene-methacrylic ester copolymer, ethylene-vinyl chloride copolymer, ethylene-vinyl acetate copolymer, ionomer resin), polyvinylpyrrolidone, methyl vinyl ether-maleic anhydride copolymers, maleic acid-modified phenol resins and phenol-modified terpene resins, and the like.

The wax (wax component (b)) forming a part (wax part) of the modified resin used in the present invention may be selected from any wax known in art, as long as it enables a graft polymerization. In those, polyolefin resins are preferred, and polyolefin resins are more preferred.

Examples of olefins having the aforesaid polyolefin resins, are ethylene, propylene, 1-butane, isobutylene, 1-hexane, 1-dodecine, 1-octadecine, and the like. Examples of polyolefin resins are olefin polymers, oxidized olefin polymers, modified olefin polymers, copolymers of other monomers which can polymerize with olefins, and the like.

Examples of olefin polymers are polyethylene, polypropylene, ethylene/propylene copolymer, ethylene/1-butene copolymer, propylene/1-hexene copolymer, and the like.

Examples of oxidized olefin polymers are oxides of the aforesaid olefin polymers.

Examples of modified olefin polymers are maleic add derivatives (maleic anhydride, monomethyl maleate, monobutyl maleate and dimethyl maleate, and the like) adducts of the aforesaid olefin polymers.

Examples of copolymers of other monomers capable of copolymerization with olefins, are copolymers of monomers such as unsaturated carboxylic adds [(meth) acrylic acid, itaconic acid, maleic anhydride, and the like], and unsaturated carboxylic alkyl esters [(meth)acrylic alkyl (C1 to C18) ester, maleic alkyl (C1–C18) ester, and the like], and olefins.

According to the present invention, the polymer structure may contain a polyolefin structure, but it is not absolutely necessary for the monomer to have an olefin structure therein. For example, polymethylene (Sazole wax and the like) may also be used.

Of these polyolefin resins, olefin polymers, oxidized olefin polymers and modified olefin polymers are preferred, polyethylene, polymethylene, polypropylene, ethylene/propylene polymer, oxidized polyethylene, oxidized polypropylene and maleic polypropylene are more preferred, and polyethylene and polypropylene are particularly preferred.

A softening point of the aforesaid polyolefin polymers is generally from about 80° C. to about 170° C., preferably from 90° C. to 160° C., and more preferably from 100° C. to 155° C. If the softening point is higher than about 80° C., toner fluid properties are good. If the softening point is lower than about 170° C., there is a sufficient mold releasing effect. Further, a number average molecular weight of the polyolefin resin is generally about 500 to about 20000 and a weight average molecular weight is about 800 to about 100000, preferably, the number average molecular weight is 1000 to 15000 and the weight average molecular weight is 1500 to 60000, and more preferably, the number average molecular weight is 1500 to 10000 and the weight average molecular weight is 2000 to 30000. A penetration of the polyolefin resin is generally about 5.0 or less, preferably 3.5 or less, and more preferably 1.0 or less.

Examples of vinyl monomers forming part (the modified part) of modified resins include alkyl (1 to 5 carbon atoms) esters of unsaturated carboxylic acids [methyl (meth) acrylate, ethyl (meth)acrylate, butyl (meth)acrylate, 2-ethyl hexyl (meth)acrylate, and the like], and vinyl ester monomers [vinyl acetate and the like]. Of these, alkyl (meth) acrylate is preferred, and alkyl (meth)acrylate having 1 to 5 carbon atoms in the alkyl chain is more preferred.

Other comonomers apart from aforesaid monomers can also be used in combination with the aforesaid vinyl monomers. These comonomers include aromatic vinyl monomers, examples being styrene monomers [styrene, α-methylstyrene, p-methylstyrene, m-methylstyrene, p-methoxystyrene, p-hydroxystyrene, p-acetoxystyrene, vinyl toluene, ethyl styrene, phenyl styrenes benzyl styrene, and the like]. Of these, styrene is preferred.

As for the molecular weight of the vinyl polymer, a number average molecular weight is about 1500 to about 100000 and a weight average molecular weight is about 50000 to about 200000, preferably, the number average molecular weight is 2500 to 50000 and the weight average molecular weight is 6000 to 100000, and more preferably, the number average molecular weight is 2800 to 20000 and the weight average molecular weight is 7000 to 50000.

A glass transition temperature (Tg) of this vinyl polymer is generally from about 40° C. to about 90° C., preferably from 45° C. to 80° C. and more preferably from 50° C. to 70° C. If Tg is higher than about 40° C., excellent storage properties are obtained, and if it is lower than about 90° C., low excellent temperature fixing properties are obtained.

In the modified resin according to the present invention, the average ester group concentration of the modified part (for example, side chain) is defined by the following formula:

$$\text{Average ester group concentration} = \sum\left(\frac{44}{Mwi} \times Wi\right)$$

wherein, "Mwi" represents a molecular weight of ester group-containing monomer, and "Wi" represents a proportion of ester group-containing monomer with respect to whole monomer forming modified part (% by weight).

If the average ester group concentration is less than about 8%, compatibility with the binder resin is poor, and if it is higher than 30%, compatibility with the mold releasing wax may be poor. In both cases, dispersion of the mold releasing wax in the binder resin may be poor.

A ratio of the content [P] of the wax component (b) in the modified resin and the content [Q] of the vinyl monomer ([P]/[Q]), is preferably in the range of 1 to 50, and more preferably in the range of 5 to 30. If the ratio is more than 50, the wax component (b) is dispersed in the composition, so the added mold releasing wax may not be sufficiently dispersed. If the ratio is less than 1, the graft copolymer is not fully incompatible with the added mold releasing wax, which impairs dispersion of the mold releasing wax.

The modified resin occludes wax as the mold releasing agent of the toner. In order to ensure the presence of an interface with the binder resin, it is preferred that the modified resin content "Y" in the toner and the mold releasing wax content "X" in the toner satisfy the following relation.

$$0.1 \leqq Y/X \leqq 3$$

Wherein, if "Y/X" is less than about 0.1, dispersion of the mold releasing wax is insufficient the dispersion particle diameter increases and transparency declines. If "Y/X" is larger than about 3, degradations occurs in the low temperature fixing properties of the polyester or polyol, and heat storage properties. The desired ratio Y/X is in the range of about 0.4 to about 2.5, and preferably in the range of about 0.5 to about 2.

The modified resin used in the present invention may be manufactured by any of the methods known in the art. Specifically, the wax for g the main chain of the modified resin is dissolved in an organic solvent, the vinyl monomer used to obtain the vinyl polymer forming the side chain is added to the organic solvent, and this wax and vinyl monomer are polymerized by a graft polymerization reaction in the presence of a polymerization initiator such as an organic peroxide in the organic solvent.

In the modified resin obtained by the aforesaid graft polymerization, unreacted wax and vinyl polymer produced by polymerization of the vinyl monomer with itself are also present, but in the case of the present invention, there is no need separate the wax and vinyl polymer from the obtained resin, and the modified resin may conveniently be used as a mixed resin containing these constituents.

In the mixed resin, a content of unreacted wax is about 5% by weight or less, and preferably 3% by weight or less. Also, a content of vinyl polymer produced by polymerization of vinyl monomer with itself is about 10% by weight or less, and preferably 5% by weight or less. In the case of the present invention, a proportion of graft polymer resin in the mixed resin is specified to be about 85% by weight or more, and preferably 90% by weight or more.

The proportion of graft polymer resin in the aforesaid mixed resin, a molecular weight thereof and a molecular weight of the vinyl polymer may be conveniently adjusted depending on conditions such as the content ratio of reacting materials, the polymerization reaction temperature, the reaction time, and the like.

A charge controlling agent contained in the toner of the present invention may be selected form any of those known in the art. Examples of positive charge controlling agents are nigrosine, basic dyes, lake pigments of basic dyes, quaternary ammonium salt compounds, and the like. Examples of negative charge controlling agents are metal salts of mono azo dyes, salicylic acid, naphthoic acid and metal complexes of dicarboxylic acids, and the like. The usage amount of the charge controlling agent is determined according to the type of binder resin, the presence or absence of conditionally utilized additives, the toner manufacturing method including the dispersion method, and the like. Although there is no limitation, therefore, the content of the charge controlling agent is about 0.01 parts by weight to about 8 parts by weight with respect to 100 parts by weight of the binder resin, and preferably within the range of 0.1 parts by weight to 2 parts by weight. If it is less than about 0.01 parts by weight, sufficient charge controlling abilities hardly exhibit relative to fluctuations of the charge amount Q/M under environmental fluctuations, whereas if it is more than 8 parts by weight low temperature fixing properties may decline.

The wax releasing agent used in the toner of the present invention may be selected from any of those known in the art, in particular ester wax, free fatty acid eliminated carnauba wax, montan wax and oxidized rice wax may be used alone or in combination. The ester wax having a branched structure is particularly superior in mold releasing effects, and it may be preferably used. The carnauba wax is preferably microcrystalline, and has an add value of about 5 or less. Moreover a particle diameter of the carnauba wax is about 1 $\mu$m or less when it is dispersed in the toner binder. For montan wax, his generally refers to montan wax refined from minerals. As well as carnauba wax, it is preferred to be microcrystalline and have an acid value of about 5 to about 14. Oxidized rice wax is prepared by the air oxidation of rice bran wax, and its acid value is preferably 10 to 30. If the acid value of these waxes is less than the corresponding ranges, the temperature of low temperature fixing rises and low temperature fixing properties are insufficient. Conversely, if the acid value is more than these ranges, the cold offset temperature may rise and low temperature fixing properties may be insufficient. A wax content of the toner is about 1 part by weight to about 15 parts by weight, and preferably 3 parts by weight to 10 parts by weight with respect to 100 parts by weight of the whole resin content of the toner. If the wax content is less than about 1 part by weight, a mold releasing effect may become insufficient so that a desired effect is difficult to obtain. If the wax content is more than about 15 parts by weight, problems may occur such that a consumption of the toner to carrier becomes excessive.

The term "wax content of the toner" means the total amount of the wax (amount of wax (a)) added during the toner manufacturing process and the unreacted wax remained after the graft polymer resin formation process. The term "whole resin content of the toner" includes not only the binder resin (resin (A)) added during the toner manufacturing process, but also the graft polymer resin (modified resin (B)) and the vinyl polymer resin produced during graft polymer resin forming process at the same time.

The toner of the present invention may be further contained a magnetic material so that it may also be used as a magnetic toner. Examples of magnetic materials contained in the magnetic toner of the present invention are metals, for example, iron oxides such as magnetite, hematite and ferrite; metals such as iron, cobalt and nickel; alloys of these metals with aluminium, cobalt, copper, lead, magnesium, tin, zinc, antimony, beryllium, bismuth, cadmium, calcium, manganese, selenium, titanium, tungsten and vanadium; and mixtures thereof. An average particle diameter of these magnetic materials is preferably of the order of about 0.1 $\mu$m to about 2 $\mu$m, and an amount contained in the toner is about 20 parts by weight to about 200 parts by weight, and preferably 40 parts by weight to 150 parts by weight with respect to 100 parts by weight of the binder resin.

The colorant used in the color toner of the present invention may be any pigment or dye known in the art which allows a yellow, magenta, cyan or black toner to be obtained. Examples of yellow pigments are cadmium yellow, mineral fast yellow, nickel titanium yellow, nebulous yellow, naphthol yellow S, Hanza yellow G, Hanza yellow 10G, benzidine yellow GR, quinoline yellow lake, permanent yellow NCG, tartrazine lake, and the like. Examples of orange pigments are molybdenum orange, permanent orange GTR, pyrazolone orange, Balkan orange, indanthrene brilliant orange RK, benzidine orange G, indanthrene brilliant orange GK, and the like.

Examples of red pigments are red iron oxide, cadmium red, permanent red 4R, Lithol Red, pyrazolone red, watching red calcium salt, Lake Red D, brilliant carmine 6B, eosin lake, rhodamine lake B, alizarin lake, brilliant carmine 3B, and the like.

Examples of purple pigments are fast violet B, methyl violet lake, and the like.

Examples of blue pigments are cobalt blue, alkali blue, Victoria blue lake, phthalocyanine blue, non-metal phthalocyanine blue, partial chloride phthalocyanine blue, fast sky blue, indanthrene blue BC, and the like.

Examples of green pigments are chrome green, chromium oxide, pigment green B, Malachite-Green lake, and the like.

Examples of black pigments are azine colorants such as carbon black, oil furnace black, channel black, lamp black, acetylene black and aniline black, metal salt azo colorants, metal oxides, oxidized metal compounds. One, two or more of these colorants may be used.

Various additives may be added to the toner of the present invention if necessary.

Examples of such additives are lubricants such as Teflon and zinc stearate; polishing agents such as cerium oxide and silicon carbide; fluid property enhancers such as colloidal silica, aluminium oxide and titanium oxide; caking inhibitors; electroconduction enhancers such as carbon black and tin oxide; image-fixing agents such as low molecular weight polyolefins; and the like. In particular, from the viewpoint of applying fluid properties, the use of hydrophobic silica is preferred, and for charge stabilization, the use of hydrophobic titanium oxide is desirable.

Examples of surface treatment agents for obtaining hydrophobic additives such as hydrophobic titanium oxide and hydrophobic silica are silicone oils, such as methyl hydrogen polysiloxane, dimethyl polysiloxane, methylphenyl polysiloxane, and the like; alkyl silanes such as methyl trimethoxysilane, ethyl trimethoxysilane, hexyl trimethoxysilane, octyl trimethoxysilane, decyl trimethoxysilane, octadecyl trimethoxysilane, dimethyl dimethoxysilane, octyl triethoxysilane, n-octadecyl dimethyl (3-(trimethoxysilyl) propyl) ammonium chloride, and the like; fluoroalkyl silanes such as trifluoromethylethyltrimethoxysilane, heptadecafluorodecyltrimethoxysilane, and the like; metal coupling agents such as silane coupling agents in particular represented by vinyltrimethoxysilane, γ-aminopropyltrimethoxysilane, and the like, titanium coupling agents, aluminum coupling agents, alumina zirconia coupling agents. These may be used alone, or two or more may be used in combination. In particular, silicone oil and the silane coupling agent shown below is desirable.

$$X—Si—(OR)_3$$

Wherein, X represents a functional group capable of reacting with organic substances, and R represents a group capable of hydrolysis.

Further, the hydrophobic silica used in the present invention may be brought in contact with an alkylhalogensilane, and then brought in contact with hexamethyldisilazane in the presence of water vapor.

The toner of the present invention can be used as a single-component toner, a double-component toner, monochrome toner or full color toner.

The toner of the present invention may be manufactured by applying any method known in the art.

Examples of devices which are suitable for kneading toner composition materials are a batch-type 2 roller Banbury mixer, continuous 2 axis extruder, and the like, for example, KTK type 2 axis extruder manufactured by Kobe Steel Ltd., TEM type 2 axis extruder manufactured by Toshiba Machine, Co., Ltd., 2 axis extruder manufactured by KCK, CO., Ltd., PCM type 2 axis extruder manufactured by Ikegai Corporation, KEX type 2 axis extruder manufactured by Kurimoto, Ltd., and a continuous one-axis kneading machine, for example, Buss Kneader manufactured by BUSS Corporation, and the like.

Before kneading, it is desirable to mix the composition materials in a Henschel mixer. Also, to uniform the dispersibility of the colorant, a treated colorant, for example, a colorant kneaded with a small amount of resin beforehand, may also be used.

The obtained melt kneaded material is cooled and ground. For example, it may be roughly ground using a hammer mill, rotoplex and the like, then more finely ground using a jet stream or a mechanical pulverizing mill. Depending on the particle size distribution of the toner obtained, a desired particle size distribution may be obtained by a wind power grader, and the like. It is preferred that a weight average particle size of the toner is in the range of about 2.5 μm to about 10 μm. If the particle size is smaller than the range, it may lead to soiling during developing, impair fluid properties which affect to toner supply and cleaning properties. Further, it may cause toner adhesions to the developing roller or developing agent coating blade. Conversely, if it is larger than the aforesaid range, there may be problems such as scattering of the toner during developing or degrading of developing properties.

External additives may be added if necessary to the obtained toner as described above, and in this case, the external additive is crushed and coated on the toner surface by mixing/stirring the toner and external additive using a mixer.

When the present invention is employed as a two-component toner, a carrier may selected from any of those known in the art, for example magnetic powders such as iron powder, ferrite powder, nickel powder; glass beads, surface coated thereof with resin, and the like.

Examples of resin powders capable of coating the carrier are styrene-acryl copolymer, silicone resin, maleic acid resin, fluorinated resin, polyester resin, epoxy resin, and the like. In the case of styrene-acrylic copolymer, it is preferred that the copolymer contains 30% by weight to 90% by weight of the styrene component In this case, if the styrene component is less than 30% by weight, developing properties may be insufficient, and if it is more than 90% by weight, the coating film becomes hard and peels off easily, and then the life of the carrier is shortened.

When the carrier is coated by a resin, a coating agent may, in addition to the aforesaid resins, contains an adhesion enhancer, setting agent, lubricant, electroconductive material, charge controlling agent, and the like.

Further, by coating the core particle surface with a silicone resin containing an electroconductive fine powder and silane coupling agent, the advantages of conventional silicone resin-coated carriers are maintained, while at the same time, charge storage within the carrier, and peeling of the coating layer or dropout of the electroconductive fine powder are effectively suppressed by conferring electroconductive properties.

Examples of carrier core particles coated with silicone resin may be any of those known in the art, for example, ferromagnetic metals such as iron, cobalt and nickel; alloys or compounds such as magnetite, haematite and ferrite; glass beads, and the like. An average particle size of these core particles is normally in the range of about 10 μm to about 1000 μm, and preferably in the range of 30 μm to 500 μm. A usage amount of the silicone resin is normally about 1% by weight to about 10% by weight with respect to the carrier core particles.

The silicone resin may be any silicone resin known in the art, commercially available examples are such as KR261, KR271, KR272, KR275, KR280, KR282, KR285, KR251, KR155, KR220, KR201, KR204, KR205, KR206, SA-4, ES1001, ES1001N, ES1002T and KR3093 manufactured by Shin-Etsu Silicones, and SR2100, SR2101, SR2107, SR2110, SR2108, SR2109, SR2115, SR2400, SR2410, SR2411, SH805, SH806A and SH840 manufactured by Toray Silicones.

As a method for forming a layer of silicone resin, likewise conventional methods, such a method is employed as that the silicon resin is applied to the surface of the carrier core particle by spraying or immersing.

The coating layer composition is prepared by adding the electroconductive fine powder and silane coupling agent to a silicone resin solution, and dispersing it with a suitable mixer.

It is preferred that a particle diameter of the electroconductive fine particles dispersed in the coating layer is of the order of about 0.01 μm to about 5.0 μm, preferred that the addition amount is about 0.01 parts by weight to about 30 parts by weight, and more preferred that it is 0.1 parts by weight to 20 parts by weight with respect to 100 parts by weight of silicone resin. The electroconductive fine powder may be carbon black as in the art, such as contact black, furnace black, thermal black.

The silane coupling agent may be any of those cited above, such as, $X—Si—(OR)_3$. In particular, as a positive charging carrier, it is preferred to use an aminosilane coupling agent containing amino groups. Moreover, an addition proportion thereof is about 0.1 parts by weight to about 10 parts by weight and preferably 0.2 parts by weight to 5 parts by weight with respect to 100 parts by weight of the silicone resin.

Specific examples of aminosilane coupling agents which may be used in the present invention are γ-(2-aminoethyl) aminopropyl trimethoxysilane, γ-(2-aminoethyl) aminopropyl methyldimethoxysilane, γ-aminopropyl trimethoxysilane, octadecyldimethyl [3-(trimethoxysilyl) propyl] ammonium chloride, and the like.

The fixing method used for the toner of the present invention is preferably a contact heat fixing method using a flat fixing surface having excellent mold releasing properties. Mold releasing oil is not applied, but even if it is applied, the coating amount is extremely small. Specifically, the fixing method uses a roller or belt having a low surface energy material such as fluorinated resin/rubber or silicone resin/rubber. It is also preferred, in order to reduce offset and recording materials take-up, that the shape of the fixing nip is concave towards the fixing roller or the fixing belt side. This is because deformation of the roller or the belt contributes to physically enlarge mold releasing force, and discharge paper from the fixing roller or fixing belt with a large release angle. Thus, it is important that the fixing roller, the fixing belt and fixing belt supporting roller have an elastic body, and that hardness thereof is designed to be lower than the hardness of the pressure roller. To shorten the waiting time as far as possible until the heat roller reaches the predetermined temperature, it is preferred to use belt heat fixing with a belt having a low heat capacity. Thus, an image-forming apparatus can be obtained which, by using the toner having the composition of the present invention, provides suitable gloss, good hot offset properties and a short waiting time.

The toner of the present invention is suitably used as a developing agent, and the developing agent of the present invention contains the toner of the present invention. The toner of the present invention may be used as one of a single-component developing agent and a double-component developing agent. The toner of the present invention is filled in a container, which is distributed and sold as a toner container. In general, this toner container is distributed separately from the image-forming apparatus, and inserted by the user into the image-forming apparatus. The container may be a bottle type container or cartridge type container, but types of container are not limited and other types of container may be used.

The image-forming apparatus, which uses the toner of the present invention, has no limitation as long as it forms an image by electrophotography, and examples thereof may include photocopier, printer, and the like.

The toner of the present invention is a toner manufactured by pulverization, but in addition to pulverization, the toner of the present invention may for example be a toner manufactured by polymerization, or a it may be a mixture thereof.

In an image-forming apparatus using a color toner known in the art, a toner image formed on a latent image bearing member is transferred to a transfer, and the toner image is fixed while bringing it into contact with a terminal belt or an endless belt. By using the color toner of the present invention, a high-quality image having suitable image gloss and excellent color reproducibility can thereby be obtained.

FIG. 1 is a descriptive diagram of an example of a basic belt fixing apparatus.

In FIG. 1, "R1" is a fixing roller, "R2" is a pressure roller, "R3" is a heating roller, "R4" is an oil coating roller, "B" is a fixing belt, "P" is a pressure spring, "G" is a guide and "H" is a heat source.

The image-forming process cartridge of the present invention, comprises a developing apparatus holding an image-forming color toner of the present invention. The developing apparatus supplies the image-forming color toner to the latent image so as to develop the latent image and form a developed image. In addition, the image-forming process cartridge of the present invention is formed in a one-piece construction which can be removed from an image-forming apparatus.

By inserting the image-forming process cartridge of the present invention into the image-forming apparatus, sufficient anti-offset properties can be obtained even using a fixing method in which a mold releasing oil is not applied, or is applied in only a small amount.

Figure 2:
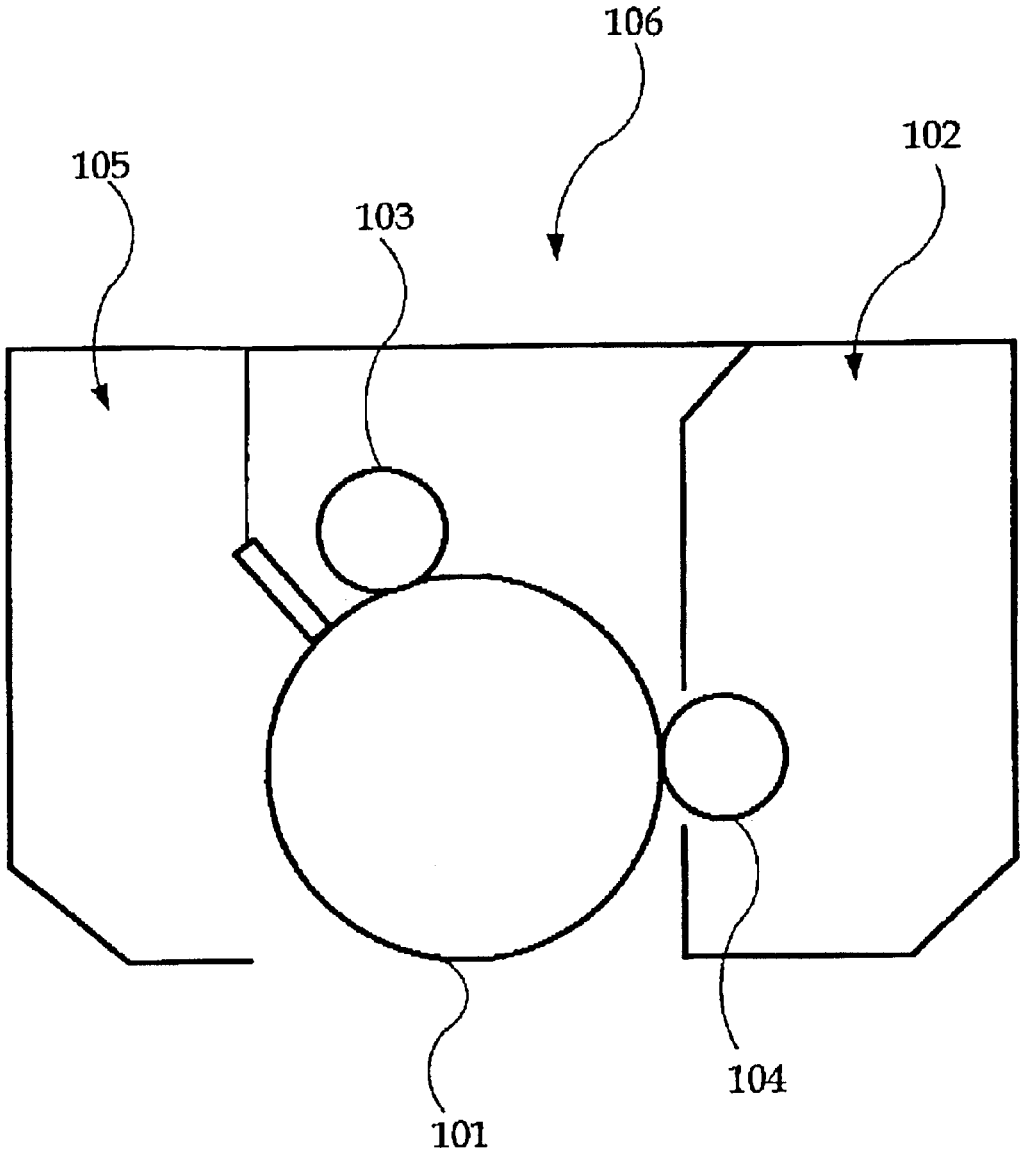
FIG. 2 is a diagram showing an example of the image-forming process cartridge of the present invention.

FIG. 2 is an example of the construction of an image-forming process unit (process cartridge) (106), having a photoconductor drum (101) which functions as the aforesaid latent image bearing member, a charging roller (103) which functions as the aforesaid charging apparatus, a cleaning apparatus (105) which functions as the aforesaid cleaning apparatus and a developing apparatus (102) which functions as the aforesaid developing apparatus, all of these being formed in a one-piece construction which can be removed from the printer body. The developing apparatus (102) has a developing agent sleeve (104).

EXAMPLES

The present invention will now be described in more detail with reference to specific examples, but it should not be limited in any way thereby. In the examples, "part" represents "part by weight" and "parts" represents "parts by weight".

An image quality evaluation was performed for various toners using an apparatus wherein the fixing part of a Ricoh IPSIO 8000 printer was modified and the oil coating mechanism was removed to permit evaluation of oilless toners. In the transfer of this apparatus, a pressing roller is placed and contacted with underneath of a transfer belt which transfers paper.

Next, some examples will be given describing the manufacture of carriers having a silicone resin coating layer. This may be done by conventional means.

(Manufacture of Carrier Particles)

(Example Manufacture of Carrier Particles)

| | |
|---|---|
| Silicone resin solution (SR2100, Toray Silicone, Inc.) | 100 parts |
| Aminosilane coupling agent | 1 part |
| Carbon black (#44 Mitsubishi Chemical Industries, Co.) | 4 parts |
| Toluene | 100 parts |

A coating layer forming liquid was prepared by dispersing the above components with a homomixer. This coating layer forming liquid was used to form a coating layer on the surface of 1000 parts by weight of magnetite core particles using a fluid bed coating apparatus, and a carrier A was thus obtained.

Next, an example of the manufacture of a modified resin is given.

(Manufacture of Modified Resin-1)

450 parts of xylene and 150 parts of a low molecular weight polyethylene (Manufactured by Sanyo Chemical Industries, Ltd., Sunwax LEL-400, softening point 128° C.) were introduced into an autoclave reaction vat fitted with a thermometer and stirrer, and thoroughly dissolved. After replacing the atmosphere by nitrogen, a mixed solution of 594 parts of styrene, 255 parts of methyl methacrylate, 34.3 parts of di-t-butylperoxyhexahydroterephthalate and 120 parts of xylene, was dripped in at 155° C. for 2 hours to carry out a polymerization, and the mixture was kept at this temperature for 1 hour. Next, the solvent was removed, and a modified resin ((a)) having an average ester group concentration of 13.2%, number average molecular weight of 3300, weight average molecular weight of 12000 and glass transition temperature of 65.2° C., was obtained.

(Manufacture of Modified Resin-2)

450 parts of xylene and 150 parts of carnauba wax (Manufactured by TOA KASEI CO. LTD., softening point 75° C.) were introduced into an autoclave reaction vat fitted with a thermometer and stirrer, and thoroughly dissolved. After replacing the atmosphere by nitrogen, a mixed solution of 594 parts styrene, 255 parts methyl methacrylate, 34.3 parts di-t-butylperoxyhexahydroterephthalate and 120 parts xylene, was dripped in at 160° C. for 2 hours to carry out a polymerization, and the mixture was kept at this temperature for 1 hour. Next, the solvent was removed, and a modified resin ((b)) having an average ester group concentration of 13.2%, a number average molecular weight of 3400, a weight average molecular weight of 12300 and a glass transition temperature of 64.8° C., was obtained.

(Manufacture of Modified Resin-3)

450 parts of xylene and 200 parts of a low molecular weight polyethylene (Manufactured by Sanyo Chemical Industries, Ltd., Sunwax LEL-400, softening point 128° C.) were introduced into an autoclave reaction vat fitted with a thermometer and stirrer, and thoroughly dissolved. After replacing the atmosphere by nitrogen, a mixed solution of 600 parts styrene, 200 parts butyl acrylate, 16.1 parts di-t-butylperoxyhexahydroterephthalate and 120 parts xylene, was dripped in at 155° C. for 2 hours to carry out a polymerization, and the mixture was kept at this temperature for 1 hour. Next, the solvent was removed, and a modified resin ((c)) having an average ester group concentration of 8.5%, a number average molecular weight of 5300, a weight average molecular weight of 18500 and a glass transition temperature of 52.0° C., was obtained.

(Manufacture of Modified Resin-4)

450 parts of xylene and 200 parts of a low molecular weight polypropylene (Manufactured by Sanyo Chemical Industries, Ltd., Viscol 440P, softening point 153° C.) were introduced into an autoclave reaction vat fitted with a thermometer and stirrer, and thoroughly dissolved. After replacing the atmosphere by nitrogen, a mixed solution of 280 parts styrene, 520 parts methyl methacrylate, 32.3 parts di-t-butylperoxyhexahydroterephthalate and 120 parts xylene, was dripped in at 150° C. for 2 hours to carry out a polymerization, and the mixture was kept at temperature for 1 hour. Next, the solvent was removed, and a modified resin ((d)) having an average ester group concentration of 28.6%, number average molecular weight of 3300, weight average molecular weight of 16000 and glass transition temperature of 58.8° C., was obtained.

(Manufacture of Modified Resin-5)

400 parts of xylene and 150 parts of a low molecular weight polypropylene (Manufactured by Sanyo Chemical Industries, Ltd., Viscol 440P, softening point 153° C.) were introduced into an autoclave reaction vat fitted with a thermometer and stirrer, and thoroughly dissolved. After replacing the atmosphere by nitrogen, a mixed solution of 665 parts styrene, 185 parts butyl acrylate, 8.5 parts di-t-butylperoxyhexahydroterephthalate and 120 parts xylene, was dripped in at 160° C. for 2 hours to carry out a polymerization, and the mixture was kept at this temperature for 1 hour. Next, the solvent was removed, and a modified resin ((e)) having an average ester group concentration of 7.49%, number average molecular weight of 8300, weight average molecular weight of 22900 and glass transition temperature of 60.5° C., was obtained.

(Manufacture of Modified Resin-6)

450 parts of xylene and 200 parts of a low molecular weight polypropylene (Manufactured by Sanyo Chemical Industries, Ltd., Viscol 440P, softening point 153° C.) were introduced into an autoclave reaction vat fitted with a thermometer and stirrer, and thoroughly dissolved. After replacing the atmosphere by nitrogen, a mixed solution of 200 parts styrene, 600 parts methyl methacrylate, 32.3 parts di-t-butylperoxyhexahydroterephthalate and 120 parts xylene, was dripped in at 150° C. for 2 hours to carry out a polymerization, and the mixture was kept at this temperature for 1 hour. Next, the solvent was removed, and a modified resin ((f)) having an average ester group concentration of 33.0%, number average molecular weight of 3200, weight average molecular weight of 17000 and glass transition temperature of 55.3° C., was obtained.

(Manufacture of Modified Resin (Vinyl Polymer)-7)

450 parts of xylene was introduced into an autoclave reaction vat fitted with a thermometer and stirrer, and thoroughly dissolved. After replacing the atmosphere by nitrogen, a mixed solution of 700 parts styrene, 300 parts methyl methacrylate, 34.3 parts di-t-butylperoxyhexahydroterephthalate and 120 parts xylene, was dripped in at 155° C. for 2 hours to carry out a polymerization, and the mixture was kept at this temperature for 1 hour. Next, the solvent was removed, and a vinyl polymer ((g)) having an average ester group concentration of 13.2%, number average molecular weight of 3500, weight average molecular weight of 9100 and glass transition temperature of 68.8° C., was obtained.

The evaluation methods and conditions used in the experiments are shown below.

(1) Gloss

[a] Adjustments were made to develop a toner of 1.0±0.1 mg/cm$^2$, using a modified Pretel 650 Ricoh color copier wherein the fixing roller was replaced by a PFA tubing-coated roller, and the silicone oil coating apparatus had been removed. The gloss of a beta image sample when temperature of the fixing roller surface was 160° C., was measured at an incidence angle of 60° C. using a Gloss Meter manufactured by Nippon Denshoku Industries Co., Ltd. The transfer paper was a Ricoh color PPC paper, type 6000<70W. Glossiness is higher as the number of the value is increased. A glossiness of approximately 10% or more is required to obtain a clear image having excellent color reproducibility.

The fixing roller had 25 $\mu$m PFA tubing coated on 2 mm silicone rubber, the fixing pressure was 80 kg, the nip width was 8 mm, and the shape of the nip was concave towards the fixing roller side. The fixing roller heating output was 650 W, and the pressure roller heating output was 400 W.

[b] A Ricoh printer IPSIO8000 was modified as follow. The original fixing apparatus was removed, and another fixing apparatus from which the oil coating mechanism had been removed was installed. Moreover the fixing apparatus was designed to allow the set temperature changeable. As in [a], adjustments were made to develop a toner of 1.0±0.1 mg/cm$^2$, and the gloss of a beta image sample when the fixing roller surface temperature was 160° C., was measured at an incidence angle of 60° C. using a Nippon Denshoku Industries Co., Ltd. Gloss Meter. The transfer paper was a Ricoh color PPC paper, type 6000<70W. Glossiness is higher as the number of the value is increased. A glossiness of approximately 10% or more is required to obtain a clear image having excellent color reproducibility.

The fixing apparatus used was the belt heat fixing apparatus shown in FIG. 1. The fixing roller was made of silicone foam, the metal cylinder of the pressure roller was SUS, 1 mm thick, the anti-offset layer of the pressure roller was made of PFA tubing and silicone rubber, 1 mm thick, the heat roller was aluminum of thickness 2 mm, the belt base was 50 μm polyimide, the offset prevention layer of the belt was 50 μm silicone rubber, the surface pressure was 1×105 Pa and the linear velocity was 200 m/sec.

(2) Offset Properties

Using the modified Pretel 650 Ricoh color copier that was employed in the gloss tests, the temperature of the fixing roller was increased every 5° C., and the temperature at which offset started was measured. Regarding the fixing roller, tests were performed without coating oil, and the transfer paper was Ricoh full color PPC paper type 6000<70W.

The evaluation of results is shown as below.

◎: Offset does not occur until extremely high temperature, and anti-offset properties are excellent.

○: Offset does not occur until high temperature, and anti-offset properties are very good.

Δ: Anti-offset properties are insufficient, but anti-offset properties are satisfied if only a small amount of silicone oil (0.5–1 mg/A4 size) is applied.

X: Offset occurs from low temperature, and anti-offset properties are poor even if only a small amount of silicone oil is applied.

(3) Transfer Properties

Using an identical copier to that used for the gloss tests, the copier was stopped during transfer to the transfer paper, and the toner amount remaining on the intermediate transfer belt was visually observed and assessed according to the following scale.

◎: Transfer toner residue is hardly remained, and transfer properties are excellent.

○: Transfer toner residue is remained only a small amount, and transfer properties are excellent.

Δ: Identical transfer properties to those of the wax-containing color toner in the related art.

X: Transfer toner residue is remained an extremely large amount, and transfer properties are poor.

(4) Durability

Using an identical printer [b] to that used for the gloss tests, a test chart of surface area 10% was copied 50000 times, and the decline in the charge amount of the developing agent was evaluated.

◎: Very little decline of charge amount, and excellent durability.

○: Little decline of charge amount, and excellent durability.

Δ: Identical durability to that of the wax-containing color toner of the related art.

X: Very large decrease of charge amount, and poor durability.

(5) Charge Stability with Humidity

A two-component developing agent was manufactured under the conditions of 10° C., 15% RH and 30° C., 90% RH. If the absolute values of the charge amount measured by the blow off method are respectively L (μc/g), and H (μc/g), the environmental fluctuation rate is given by the following equation. The environmental fluctuation rate is preferably at least of the order of 40% or less, but more preferably 20% or less.

Environmental fluctuation rate=2(L−H)/(L+H)×100 (%)

The test criteria in Table 1 are given below.

◎: Environmental fluctuation rate is 20% or less

○: Environmental fluctuation rate is 21% to 40%

Δ: Environmental fluctuation rate is 41% to 70%

X: Environmental fluctuation rate is 71% or higher (6) Fine Line Reproducibility For various developing agents, an image test was performed and the fine line reproducibility was evaluated in 5 steps according to the criteria below.

◎: Excellent, ○: Good, □: Normal, Δ: Poor, X: Very poor (7) Pulverizability

The processing amount per unit time was calculated for a toner ground to an average particle size of 1 mm or less under fixed conditions by a Japan Pneumatic IDS pulverizer, and evaluated according to the following criteria.

◎: 7 kg or more, ○: 7 kg to 5 kg, □: 5 kg to 3 kg, Δ: 3 kg to 2 kg, X: 2 kg or less Example 1

| (Toner components) | |
|---|---|
| Polyester resin (A) (binder resin) (THF insoluble fraction: 0 wt %, Mw: 18000, Mn: 4700, Tg: 60° C. Tm (softening point): 115° C., SP value (solution parameter): 10.7) | 80 parts by weight |
| Graft polymer resin ((a)) | 10 parts by weight |
| Synthetic ester wax (mold releasing agent) (Mp (melting point): 92° C., SP value 8.0) | 4 parts by weight |
| Salicylic acid metal compound (charge controlling agent) | 1.5 parts by weight |
| Quinacridone magenta pigment (C.I. Pigment Red 122) (colorant) | 4 parts by weight |

A mixture of the aforesaid components was thoroughly stirred and mixed in a Henschel mixer, melted in a roll mill at the temperature of 130° C. to 140° C. for approximately 30 minutes, and cooled to room temperature. The obtained kneaded product was crushed and graded by a jet mill so as to obtain a toner parent material having a volume average particle diameter of 6.5 μm. When the cross-sectional surface of this toner was observed with a transmitting electron microscope, it was found that the wax was incompatible with the resin, and had a "sea-island" phase separation structure. An island-like graft polymer resin was dispersed in a sea of polyester resin, and the wax was effectively contained in this graft polymer resin. The following additives were further added and mixed in a Henschel mixer for 300 seconds, setting the sting blade tip peripheral speed to 20 m/sec. Subsequently, it was sieved by a sieve having opening of 100 μm to obtain a toner <a> of the present invention.

| (Additives) | |
|---|---|
| Hydrophobic rutile titanium oxide (isobutyl trimethoxy silane surface-treated product), average first-order particle diameter: 0.02 μm) | 0.8 parts |
| Hydrophobic silica (hexamethyldisilazane surface-treated product, specific surface area: 200 $m^2/g$) | 0.6 parts |

When the image gloss of this toner was examined in the aforesaid apparatus [a], it was found that the glossiness was 22% which is a suitable gloss for a color toner, and when it was examined in the aforesaid apparatus [b], the glossiness was 15%.

Example 2

A toner <b> was manufactured in an identical way to that of Example 1, except that the toner weight average particle diameter of Example 2 was 9.5 μm.

Example 3

A toner <c> was obtained in an identical way to that of Example 1, except that the polyester resin (A) in Example 1 was replaced by a polyester resin (B) (THF insoluble fraction: 10 wt %, Mw: 100000, Tg: 65° C., Tm: 145° C., SP value: 10.7).

Example 4

A toner <d> was manufactured in an identical way to that of Example 1, except that the graft polymer resin ((a)) of Example 1 was replaced by a graft polymer resin ((b)).

Example 5

A toner <e> was manufactured in an identical way to that of Example 1, except that the graft polymer resin ((a)) of Example 1 was replaced by a graft polymer resin ((c)).

Example 6

A toner <f> was manufactured in an identical way to that of Example 1, except that the graft polymer resin ((a)) of Example 1 was replaced by a graft polymer resin ((d)).

Example 7

A toner <g> was manufactured in an identical way to that of Example 1, except that the synthetic ester wax in Example 1 was replaced by 5 parts of a free fatty acid eliminated carnauba wax (Mp: 82° C.).

Example 8

A toner <h> was manufactured in an identical way to that of Example 1, except that the synthetic ester wax in Example 1 was replaced by 5 parts of a low molecular weight polyethylene (Mp: 92° C.).

Example 9

A toner <i> was manufactured in an identical way to that of Example 1, except that the 10 parts of the graft polymer resin ((a)) in Example 1 was replaced by 5 parts.

Example 10

A toner <j> was manufactured in an identical way to that of Example 1, except that the 10 parts of the graft polymer resin ((a)) in Example 1 was replaced by 0.3 parts.

Example 11

A toner <k> was manufactured in an identical way to that of Example 1, except that the 10 parts of the graft polymer resin in Example 1 was replaced by 15 parts.

Comparative Example 1

A toner <l> was manufactured in an identical way to that of Example 1, except that the graft polymer resin ((a)) of Example 1 was replaced by a graft polymer resin ((e)).

Comparative Example 2

A toner <m> was manufactured in an identical way to that of Example 1, except that the graft polymer resin ((a)) of Example 1 was replaced by a graft polymer resin ((f)).

Comparative Example 3

A toner <n> was manufactured in an identical way to that of Example 1, except that the graft polymer resin ((a)) of Example 1 was replaced by a graft polymer resin ((g)).

Comparative Example 4

A toner was prepared in an identical way to that of Example 1, except that the graft polymer resin ((a)) of Example 1 was removed so that 100 parts by weight of the polyester resin (A) was used, and a toner parent material (p) was obtained. When the cross-section of the toner (p) was observed under a transmitting electron microscope, it was found that the wax was incompatible with the resin, had a phase separation structure, and the long axis of the particle diameter in the wax dispersion was frequently as long as 3 μm. Also, identical additives were added to those of Example 1.

A sample of this toner was prepared in the same way except that the copier (a), and OHP paper (TYPE PPC-DX (Manufactured by Ricoh Elemex Corporation) was used to measure color characteristics and glossiness. When the haze (proportion of diffused light transmittance relative to total light transmittance (also referred to as cloudiness or cloudiness value)) was measured, it was 43% which was poor compared to the toner of the Examples, all the toners of the Examples showing 30% or less.

The test results for each toner/developing agent are shown in Table 1.

TABLE 1

| | Gloss (%) | | Offset | Transfer | | | Charge | Fine line |
|---|---|---|---|---|---|---|---|---|
| | (a) | (b) | properties | properties | Durability | Pulverizability | stability | reproducibility |
| Example 1 | 25 | 15 | ○–◎ | ○–◎ | ○–◎ | ○ | ○ | ◎ |
| Example 2 | 25 | 15 | ○–◎ | ○–◎ | ○–◎ | ○ | ○ | ○ |
| Example 3 | 15 | 10 | ○–◎ | ○ | ○–◎ | ○ | ◎ | ◎ |
| Example 4 | 20 | 12 | ○–◎ | ○ | ○–◎ | ○ | ○ | ◎ |
| Example 5 | 22 | 18 | ○–◎ | ○–◎ | ○–◎ | ○ | ◎ | ◎ |
| Example 6 | 27 | 17 | ○–◎ | ○ | ○ | ○ | ○ | ◎ |
| Example 7 | 28 | 15 | ◎ | ○–◎ | ○–◎ | ○ | ○ | ◎ |
| Example 8 | 25 | 14 | ○ | ○–◎ | ○–◎ | ○ | ○ | ◎ |
| Example 9 | 28 | 18 | ○–◎ | ○–◎ | ○–◎ | ○ | ○ | ◎ |
| Example 10 | 30 | 20 | ○–◎ | ○ | ○ | ○ | ○ | ◎ |
| Example 11 | 23 | 15 | ○–◎ | ◎ | ◎ | ◎ | ◎ | ◎ |
| Com. Ex. 1 | 26 | 16 | ○–◎ | Δ | Δ–○ | ○ | X | ◎ |
| Com. Ex. 2 | 30 | 21 | ○–◎ | Δ | Δ–○ | □ | ○ | ◎ |

TABLE 1-continued

| | Gloss (%) | | Offset | Transfer | | | Charge | Fine line |
|---|---|---|---|---|---|---|---|---|
| | (a) | (b) | properties | properties | Durability | Pulverizability | stability | reproducibility |
| Com. Ex. 3 | 22 | 14 | ○–◎ | Δ | Δ | ○–◎ | ○ | ◎ |
| Com. Ex. 4 | 28 | 19 | ◎ | Δ | Δ | □ | Δ | ◎ |

As described above, the present invention provides a color toner and a developing agent which give a suitable image gloss and have excellent color reproducibility, which have sufficient anti-offset properties even when a mold releasing oil is not coated on a fixing roller or is coated in only a small amount, and which have excellent transfer properties, durability, charge stability to fluctuation of humidity and crushing properties. Further, the present invention provides a color toner and a developing agent which give a suitable image gloss and have excellent color reproducibility, which have sufficient anti-offset properties even when a mold releasing oil is not coated on a fixing roller or is coated in only a small amount, and which have excellent transfer properties, durability, charge stability to fluctuation of humidity and crushing properties, even when belt heat fixing method is employed wherein the waiting time is short.

The present invention also provides a toner container filled with the toner of the present invention, an image-forming apparatus in which the toner container is installed, an image-forming process cartridge in which the developer for supplying the toner of the present invention is installed, and an image-forming process which efficiently produce a high quality image as mentioned above using the toner of the present invention.

What is claimed is:

1. An image-forming color toner, comprising:

a colorant;

a resin (A);

a modified resin (B); and wax (a) as a mold releasing agent;

wherein the image-forming color toner has a phase separated structure having the modified resin (B) as a domain in the resin (A) as a continuous phase, and wax (a) being effectively contained in the modified resin (B), and the modified resin (B) comprises a graft copolymer having a principal chain formed of a wax component (b) and a side chain comprising a copolymer of at least one aromatic vinyl monomer and at least one ester-group containing monomer selected from alkyl esters of unsaturated carboxylic acids and vinyl ester monomers, wherein the at least one ester-group containing monomer is present in said side chain in an amount sufficient to provide an average ester group concentration of 8% by weight to 30% by weight.

2. An image-forming color toner according to claim 1, wherein the average ester group concentration is in the range of the 10% by weight to 25% by weight.

3. An image-forming color toner according to claim 1, wherein the wax component (b) is a polyolefin resin.

4. An image-forming color toner according to claim 3, wherein the polyolefin resin has a softening point within the range of 80° C. to 170° C.

5. An image-forming color toner according to claim 3, wherein the polyolefin resin has a number average molecular weight of 500 to 20000, and a weight average molecular weight of 800 to 100000.

6. An image-forming color toner according to claim 1, wherein the resin (A) effectively omits a tetrahydrofuran-insoluble component and a weight average molecular weight thereof is in the range of 10000 to 90000 as determined by GPC.

7. An image-forming color toner according to claim 1, wherein the wax (a) is at least one selected from carnauba wax, montan wax, oxidized rice wax and synthetic ester wax.

8. An image-forming color toner according to claim 1, wherein a modified resin (B) content of the image-forming color toner expressed by "Y" and a wax (a) content of the image-forming color toner expressed "X", satisfies the following relation:

$$0.1 \leq Y/X \leq 3.$$

9. An image-forming color toner according to claim 1, wherein a modified resin (B) content of the image-forming color toner expressed by "Y" and a wax (a) content of the image-forming color toner expressed by "X", satisfies the following relation:

$$0.5 \leq Y/X \leq 2.$$

10. An image-forming color toner according to claim 1, wherein 80% to 100% of all the wax contained in the image-forming color toner, is contained in the modified resin (B).

11. An image-for g color toner according to claim 1, wherein a weight average particle diameter thereof is in the range of 2.5 $\mu$m to 8.0 $\mu$m.

12. An image-forming color toner according to claim 1, wherein the principal chain formed of the wax component (b) is a polyolefin resin, and the side chain formed of a vinyl polymer contains a styrene monomer, and at least one of an alkyl ester of an unsaturated carboxylic acid and a vinyl ester monomer, as a monomer unit.

13. An image-forming color toner according to claim 12, wherein the aromatic vinyl monomer is a styrene monomer and the at least one ester group containing monomer is an alkyl ester of an unsaturated carboxylic acid.

14. A two component developing agent, comprising an image-forming color toner and a carrier, wherein the image-forming color toner comprises:

a colorant;

a resin (A);

a modified resin (B); and wax (a) as a mold releasing agent;

in which the image-forming color toner has a phase separated structure having the modified resin (B) as a domain in the resin (A) as a continuous phase, and wax (a) being effectively contained in the modified resin (B), and the modified resin (B) comprises a graft copolymer having a principal chain formed of a wax component (b) and a side chain comprising a copolymer of at least one aromatic vinyl monomer and at least one ester-group containing monomer selected from alkyl esters of unsaturated carboxylic acids and vinyl ester monomers, wherein the at least one ester-group containing monomer is present in said side chain in an amount sufficient to provide an average ester group concentration of 8% by weight to 30% by weight.

15. A toner container comprising an image-forming color toner therein, wherein the image-forming color toner comprises:

a colorant;

a resin (A);

a modified resin (B); and wax (a) as a mold releasing agent;

in which the image-forming color toner has a phase separated structure having the modified resin (B) as a domain in the resin (A) as a continuous phase, and wax (a) being effectively contained in the modified resin (B), and the modified resin (B) comprises a graft copolymer having a principal chain formed of a wax component (b) and a side chain comprising a copolymer of at least one aromatic vinyl monomer and at least one ester-group containing monomer selected from alkyl esters of unsaturated carboxylic acids and vinyl ester monomers, wherein the at least one ester-group containing monomer is present in said side chain in an amount sufficient to provide an average ester group concentration of 8% by weight to 30% by weight.

16. An image-forming color toner, comprising:

a colorant;

a resin (A), wherein resin (A) effectively omits a tetrahydrofuran-insoluble component, and a weight average molecular weight thereof is in the range of 10000 to 90000 as determined by GPC;

a modified resin (B); and wax (a) as a mold releasing agent;

wherein the image-forming color toner has a phase separated structure having the modified resin (B) as a domain in the resin (A) as a continuous phase, and wax (a) being effectively contained in the modified resin (B), and the modified resin (B) comprises a wax part formed of the wax component (b), and a modified part having a vinyl monomer unit and an average ester group concentration of 8% by weight to 30% by weight.

17. An image-forming color toner, comprising:

a colorant;

a resin (A), wherein resin (A) effectively omits a tetrahydrofuran-insoluble component, and a weight average molecular weight thereof is in the range of 10000 to 90000 as determined by GPC;

a modified resin (B); and wax (a) as a mold releasing agent;

wherein the image-forming color toner has a phase separated structure having the modified resin (B) as a domain in the resin (A) as a continuous phase, and wax (a) being effectively contained in the modified resin (B), and the modified resin (B) comprises a principal chain formed of a wax component (b), and a side chain formed of a vinyl polymer and having an average ester group concentration of 8% by weight to 30% by weight, wherein the principal chain formed of the wax component (b) is a polyolefin resin, and the side chain formed of a vinyl polymer contains a styrene monomer, and at least one of an alkyl ester of an unsaturated carboxylic acid and a vinyl ester monomer, as a monomer unit.

* * * * *